US007151248B2

(12) United States Patent
Harush et al.

(10) Patent No.: US 7,151,248 B2
(45) Date of Patent: Dec. 19, 2006

(54) METHOD AND APPARATUS FOR EQUALIZING PRESSURE BETWEEN ROLLERS IN A PRINTING PRESS

(75) Inventors: Shlomo Harush, Nes-Ziona (IL); Omer Gila, Rehovot (IL); Eyal Shelef, Tel-Aviv (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 29 days.

(21) Appl. No.: 10/890,614

(22) Filed: Jul. 14, 2004

(65) Prior Publication Data

US 2006/0011817 A1 Jan. 19, 2006

(51) Int. Cl.
*G06M 7/00* (2006.01)
*G03G 15/00* (2006.01)

(52) U.S. Cl. ..... 250/221; 399/49; 101/484

(58) Field of Classification Search ..... 250/221, 250/222.1, 223 R, 234; 399/45, 49, 72, 74, 399/331; 101/484, 141, 233
See application file for complete search history.

(56) References Cited

U.S. PATENT DOCUMENTS 6,601,512 B1 * 8/2003 Yamamoto et al. ..... 101/484

* cited by examiner

*Primary Examiner*—Kevin Pyo

(57) ABSTRACT

Apparatus for equalizing pressure along a nip between a photosensitive imaging cylinder (PIC) and an intermediate transfer member (ITM) in a printing press comprising:

first and second optical sensors having first and second fields of view respectively that view different first and second regions of a substrate printed by the printer and generate signals responsive to the optical densities of first and second test patterns printed by the printer on the first and second regions of the substrate;

at least one motor operable to control pressure between the rollers; and a controller that receives the signals and controls the at least one motor responsive to the signals to equalize the pressure along the nip.

47 Claims, 2 Drawing Sheets

METHOD AND APPARATUS FOR EQUALIZING PRESSURE BETWEEN ROLLERS IN A PRINTING PRESS

FIELD OF THE INVENTION

The invention relates to printers and in particular to apparatus and methods of automatically adjusting pressure between rollers that transfer colorant in a printer in order to print an image on the substrate.

BACKGROUND OF THE INVENTION

To print an image on an appropriate substrate, a typical digital printer first forms a copy of the image, conventionally referred to as a "latent image", on a photosensitive surface of a cylindrical roller, hereinafter referred to as a "photosensitive imaging cylinder" (PIC). To form the latent image a charger deposits a substantially constant charge density on the "photosurface". The latent image is then formed by a laser that scans the charged photosurface and discharges regions thereon to generate a pattern of charged and uncharged pixels on the photosurface that replicates the image to be printed. A developer applies toner, hereinafter generically, toner, of desired color to the charged or the uncharged pixels using an electrophoretic process to form a developed image.

In some digital printers, the developed image on the PIC is then transferred from the PIC to a suitable transfer surface of another roller, conventionally referred to as an "intermediate transfer member" (ITM). The developed image is transferred from the ITM to a substrate to print the image when the sheet passes through a nip between the ITM and an impression roller. The transfer surface of the ITM may be a surface of a removable printing blanket. In other printers, the developed image is transferred directly from the PIC to the substrate.

The amount of toner that is transferred from dots of toner on the photosurface of the PIC to the blanket of the ITM and the quality of the transfer is sensitive to an amount of pressure with which the PIC and ITM contact each other along their nip. In addition, the dot gain of the transfer is a function of the pressure. Pressure between the PIC and the ITM should be substantially the same for all regions of the nip and magnitude of the pressure should be such as to provide for proper printing press operation and quality of images printed by the press. If contact pressure between the PIC and ITM is too high, the image may be damaged during transfer, for example, by dot spreading or blurring of the image. Too much pressure also usually results in an increased wear rate for both the ITM blanket and PIC photosurface.

On the other hand, if contact pressure between the ITM and PIC is too low, too little toner may be transferred from the PIC to the ITM, resulting in colors in the image being washed out. If pressure is not substantially the same for all regions along the nip a printed image may be mottled, with some regions of the image receiving too much toner and other regions too little toner.

Generally, the surface of the ITM blanket is resilient so that spacing between the PIC and the ITM in a printing press controls pressure in the nip between them. As necessary, the spacing may be periodically adjusted to maintain printed image quality and proper printer operation. Pressure adjustment usually involves printing a suitable test pattern on a substrate and visually inspecting the printed test pattern to determine if the printed image looks good and, if the inspection warrants, manually adjusting the pressure. The process of printing and inspecting the test pattern and adjusting pressure is repeated until the pressure is deemed satisfactory. However, visual inspection and manual pressure adjustment are subjective, generally tedious and wasteful of press operator time.

SUMMARY OF THE INVENTION

An aspect of some embodiments of the present invention relates to a method and pressure adjustment apparatus (PAA) for automatically adjusting the pressure between contacting rollers in a printer.

An aspect of some embodiments of the present invention relates to a method for adjusting pressure between two rollers in a printer so that the pressure between the two rollers is substantially the same for different regions of the nip.

In some embodiments of the invention the printer is a digital printer. In some embodiments the pressure adjusted is a pressure between a PIC and an ITM.

In an embodiment of the invention, the PAA comprises at least one optical sensor, such as a densitometer, which it uses to sense optical density of at least one image printed by the printer. The PAA adjusts the pressure responsive to the sensed optical density so that at different regions of the nip the pressure is substantially the same.

In an embodiment of the invention, a PAA comprises at least one pressure control device for controlling pressure between the PIC and ITM of a printer along their common nip, a controller that controls the at least one pressure control device and first and second densitometers. The first and second densitometers have first and second fields of view respectively. Optionally, the densitometers are positioned so that, for a substrate printed by the printer, regions of the substrate along opposite first and second edges of the substrate that are substantially parallel to a printing direction of the printer, pass into the first and second fields of view respectively.

The printer is operable in a pressure calibration mode in which it prints substrate sheets with at least one first test pattern and at least one second test pattern. The at least one first test pattern is printed in a region of the first edges of the sheets that pass into the first field of view and the at least one second test pattern in a region of the second edges of the sheets that passes into the second field of view. The first and second test patterns are therefore printed at regions of the nip that are located relatively close to first and second opposite ends respectively of the nip.

For a given test pattern, the optical density (OD) of the printed test pattern is a function of pressure between the PIC and the ITM in the region of the nip at which the test pattern is printed on the substrate and generally increases with increase in pressure between the PIC and ITM. The ODs of the printed first and second test patterns are therefore measures of the pressure between the PIC and ITM in regions of the nip in the neighborhoods of the first and second ends of the nip. Optionally, the printed first and second test patterns are printed copies of a same test pattern.

The first and second densitometers generate signals responsive to the ODs of the first and second test patterns that pass into their respective fields of view and transmit the signals to the controller. The controller processes the signals it receives from the first and second densitometers to control the at least one pressure control device and adjust pressure between the PIC and ITM so that pressure is substantially the same on opposite ends of the nip and equal to a desired pressure.

In an embodiment of the invention, the PAA controls the at least one pressure device to control distances between ends of the axis of the PIC and ends of the axis of the ITM and control thereby pressure between the PIC and the ITM. It decreases distance between an end of the PIC axis and a corresponding nearby end of the ITM to increase pressure between the PIC and ITM in a region of their nip close to the axes ends. It increases the distance to decrease pressure in the nip region close to the ends. In an embodiment of the invention, the PAA controls the distances so that the printer prints the test patterns a plurality of times, for different distance settings between the ends of the PIC and ITM axes. At each distance setting, the densitometers generate signals responsive to the ODs of the first and second test patterns.

The PAA processes the signals and corresponding distances to determine normative operating distances for the ends of the axes relative to each other for which pressure between the PIC and ITM is substantially equal at opposite ends of the nip. In an embodiment of the invention, the PAA then automatically sets the distances to the normative operating distances to adjust pressure between the PIC and the ITM so that the pressure is substantially the same at regions along the nip.

Optionally, the PAA processes densitometer signals responsive to the OD of a printed test pattern to generate a value for the percent dot-area coverage, hereinafter "DA", of an area on which the test pattern is printed. The PAA uses the DA of the test pattern as an indicator of the OD of the test pattern and of the pressure between the PIC and ITM in a region of the nip at which the pattern is printed.

Applicants have found that the DA of a test pattern is a function of the distance between ends of the PIC and ITM axes that are near to the end of the nip at which the pattern is printed. The DA at first rises rapidly as the distance decreases. In a second range of distances rate of rise is moderated substantially and a graph of DA as a function of distance exhibits a "knee". For even smaller distances, the curve rises slowly to an asymptotic maximum DA with decrease in the distance.

In some embodiments of the invention, a normative operating distance between an end of the PIC axis and its corresponding nearby end of the ITM axis is a distance for which the DA of the printed test pattern has a value near the knee. In some embodiments of the invention, the normative distance is a distance for which the DA of the test pattern is marginally less than the maximum DA. Optionally, the DA of the test pattern has a value in a range from 0.96 to 0.98 of the maximum. Optionally, the DA has a vale in a range from 0.94 to 0.96 of the maximum. Optionally, the DA has a vale in a range from 0.90 to 0.94 of the maximum.

While the invention is described herein in the context of digital printers, it is generally applicable to offset or other printers that use plates or other image sources.

It should be noted that while the details of the method of determining the desired spacing is described with respect to a system in which the spacing at the ends of the rollers is separately adjustable, it is applicable to the case where only a common spacing is adjusted and one or more printed areas are used to determine the desired spacing (pressure).

There is therefore provided, in accordance with an embodiment of the invention, apparatus for equalizing pressure along a nip between a photosensitive imaging cylinder (PIC) and an intermediate transfer member (ITM) in a printing press comprising:

first and second optical sensors having first and second fields of view respectively that view different first and second regions of a substrate printed by the printer and generate signals responsive to the optical densities of first and second test patterns printed by the printer on the first and second regions of the substrate;

at least one motor operable to control pressure between the rollers; and a controller that receives the signals and controls the at least one motor responsive to the signals to equalize the pressure along the nip.

In an embodiment of the invention, the controller controls the at least one motor to vary the pressure so that on, a substrate printed by the printer, the signals indicate that the optical densities of the first and second patterns have substantially a same optical density.

Optionally, the optical densities of the first and second patterns are relative optical densities, relative to maximum optical densities respectively of the first and second patterns. Optionally, the same relative optical density indicated by the signals has a value in a range from 0.96 to 0.98. Optionally, the same relative optical density indicated by the signals has a value in a range from 0.94 to 0.96. Optionally, the same relative optical density indicated by the signals has a value in a range from 0.90 to 0.94.

Optionally, the first and second printed test patterns are printed copies of a same test pattern.

Optionally, the first and second regions are located adjacent first and second opposite edges of the substrate that are substantially parallel to a printing direction of the printer. Optionally, the first and second regions are homologously located with respect to the first and second edges respectively.

In an embodiment of the invention, an axis of rotation of the PIC has first and second ends near opposite first and second ends of the nip, which first and second ends of the PIC axis are located at first and second distances respectively from an axis of rotation of the ITM, and the at least one motor is controllable by the controller to selectively move the first and second axis ends towards or away from the ITM axis to respectively increase or decrease pressure between the PIC and the ITM in regions of the first and second ends of the nip.

Optionally, the controller controls the at least one motor to move the first and second ends independently of each other. Optionally, the controller controls the printer to print the first and second test patterns on a plurality of substrate sheets. Optionally, the controller controls the at least one motor so that different substrates of the plurality of substrates are printed with the test patterns at different values for the first and second distances.

Optionally, the different distance values are in a range of distance values comprising first and second minimum values for which signals generated by the first and second optical sensors respectively indicate that the optical densities of the first and second test patterns are substantially equal to a maximum optical density, $OD_M$, for the test patterns.

Optionally, the different values for the distances are in a range of distances comprising first and second maximum distances for which signals generated by the first and second optical sensors respectively indicate that the optical densities of the first and second test patters are substantially equal to an OD substantially less than $OD_M$.

Optionally, for each of the different values of the first and second distances, the controller determines a value for dot-area coverages (DA) of the first and second test patterns responsive to signals from the first and second optical sensors. Optionally, the controller determines first and second normative operating distances respectively for the first and second distances responsive to the different distance values at which the first and second test patterns are printed and their associated values of DA and for which normative operating distances, the DAs of the first and second test patterns are substantially equal to a same desired normative value DA* and for which pressure in regions of the first and second ends of the nip are substantially equal to a same desired normative pressure P*. Optionally, the controller determines DA* responsive to a maximum value for DA that occurs when the optical densities of the first and second patterns are maximum.

In various embodiments of the invention, DA* has a value in a range from 0.94 to 0.98, a range for 0.94 to 0.96 or 0.90 to 0.94.

Optionally, the controller determines a functional relationship for the DA of each of the first and second test patterns that relates the DA of the test pattern to the first and second distance respectively and uses the functional relationships to determine DA*. Optionally, each functional relationship is characterized by a transition region of distances in which a rate of change of DA changes from a relatively rapid to a relatively slow increase with decrease in the first or second distance and the controller determines DA* responsive to values of DA for distances in the transition region. Optionally, the controller determines DA* equal to a value of DA for which the first and second distances are distances in or near the transition region. Optionally, the controller controls the at least one motor to set the first distance substantially equal to the first normative operating distance and the second distance substantially equal to the second normative operating distance.

Optionally, during printing of non-test images on additional substrates, after the controller has set the first and second distances to the first and second normative operating distances, the printer prints at least one monitor test pattern on a region of the substrates that is not printed with the images and at least one of the first and second optical sensors generates signals responsive to the optical density of the at least one monitor test pattern. Optionally, if the monitor test signal indicate that, were first and second test patterns to be printed again, the optical density would to differ from DA* by an amount greater than or equal to a predetermined difference, the controller controls the at least one motor to adjust the first and/or second distance. Optionally, if the monitor test signal indicate that, were first and second test patterns to be printed again, the optical density would to differ from DA* by an amount greater than or equal to a predetermined threshold difference, the controller generates a signal indicating that operator intervention is required.

Optionally, the first and second optical sensors are densitometers.

There is further provided, in accordance with an embodiment of the invention, a method for equalizing pressure along a nip between a photosensitive imaging cylinder (PIC) and an intermediate transfer member (ITM) in a printing press, comprising:

controlling the printer to print first and second test patterns on different regions of at least one substrate;

sensing the optical densities, ODs, of the printed test patterns; and automatically substantially equalizing the pressure along the nip responsive to the sensed optical densities.

In an embodiment of the invention, where the PIC has an axis of rotation having first and second ends near opposite first and second ends of the nip, which first and second ends of the PIC axis are located at first and second distances respectively from an axis of rotation of the ITM, and controlling the printer to print the first and second test patterns comprises controlling the printer to print the test patterns at different values for the first and second distances.

Optionally, the method includes sensing for each of the different values of the first and second distances, the ODs of the first and second test patterns.

Optionally, the method includes determining for each of the different values of the first and second distances, a value for dot-area coverages (DA) of the first and second test patterns responsive to the ODs of the sensed ODs of the patterns. Optionally, the method includes determining first and second normative operating distances respectively for the first and second distances responsive to the different distance values at which the first and second test patterns are printed and their associated DA values and for which normative operating distances the DAs of the first and second test patterns are substantially equal to a same normative optical density DA* and pressure along the nip is substantially equalized. Optionally, the method includes determining DA* responsive to a maximum value for DA that occurs when the optical densities of the first and second patterns are maximum.

Optionally, various embodiments of the method include determining DA* to have a value in a range from 0.96 to 0.98, a range from 0.94 to 0.96 or a range from 0.90 to 0.94. In some embodiments it may be as high as 0.99.

In an embodiment of the invention, the method includes determining a functional relationship for the DA of each of the first and second test patterns that relates the DA of the test pattern to the first and second distance respectively and using the functional relationships to determine DA*.

In an embodiment of the invention, where each functional relationship is characterized by a transition region of distances in which a rate of change of DA changes from a relatively rapid to a relatively slow increase with decrease in the first or second distance and comprising determining DA* responsive to values of DA for distances in the transition region.

Optionally, the different values for the distances are in a range of distances comprising first and second maximum distances for which the optical densities of the first and second test patters are substantially equal to an OD substantially less than $OD_M$.

Optionally, the different distance values are in a range of distance values comprising first and second minimum values for which the optical densities of the first and second test patterns are substantially equal to a maximum optical density, $OD_M$, for the test patterns.

Optionally, substantially equalizing the pressure along the nip comprises setting the first distance substantially equal to the first normative operating distance and the second distance substantially equal to the second normative operating distance.

In an embodiment of the invention, the method comprises:

during conventional printing of images on substrates after equalizing the pressure, controlling the printer to print at least one monitor test pattern on a region of the substrates that is not printed with the images;

sensing the optical density of the at least one test pattern; and determining if pressure in regions along the nip is the same to within a predetermined maximum difference responsive to the sensed optical density.

There is further provided, in accordance with an embodiment of the invention, apparatus for adjusting pressure between a first and a second roller in a printing press that contact each other, comprising:

at least one optical sensor that generates signals responsive to the optical density (OD) of at least one test pattern that the printer prints on substrates;

at least one motor operable to control pressure between the rollers; and a controller that receives the optical sensor signals and controls the at least one motor responsive to the signals.

Optionally, the at least one optical sensor comprises first and second optical sensors having first and second fields of view respectively that view different first and second regions of a substrate printed by the printer.

Optionally, the controller controls the at least one motor so that the signals indicate that the optical densities of the first and second patterns have substantially a same optical density.

Optionally, the optical densities of the first and second patterns are relative optical densities, relative to maximum optical densities respectively of the first and second patterns. Optionally, the same relative optical density indicated by the signals is a density having a value in a range from 0.96 to 0.98, a range form 0.94 to 0.96 or a range form 0.90 to 0.94.

In an embodiment of the invention, the first roller is a photosensitive imaging cylinder (PIC) in the printing press.

In an embodiment of the invention, the second roller is an intermediate transfer member (ITM) in the printing press.

Optionally, the at least one optical sensor comprises at least one densitometer.

BRIEF DESCRIPTION OF FIGURES

Non-limiting examples of embodiments of the present invention are described below with reference to figures attached hereto, which are listed following this paragraph. In the figures, identical structures, elements or parts that appear in more than one figure are generally labeled with a same numeral in all the figures in which they appear. Dimensions of components and features shown in the figures are chosen for convenience and clarity of presentation and are not necessarily shown to scale.

DETAILED DESCRIPTION OF EXEMPLARY EMBODIMENTS

Figure 1:
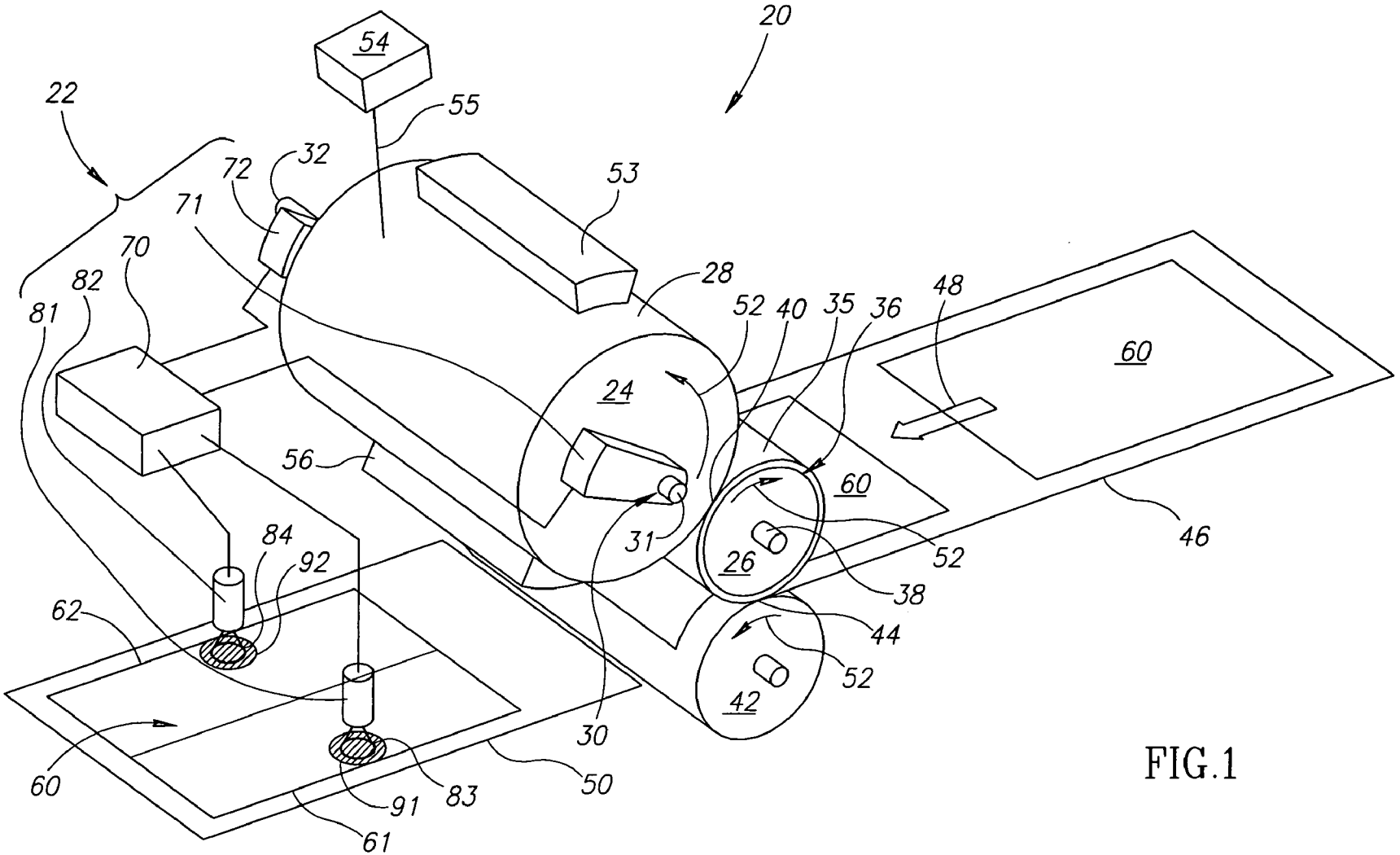
FIG. 1 schematically shows a digital printing press comprising pressure adjustment apparatus for adjusting pressure between a PIC and ITM comprised in the printer, in accordance with an embodiment of the present invention.

FIG. 1 schematically shows a digital printer 20 comprising pressure adjusting apparatus (PAA) 22 for automatically adjusting pressure between a photosensitive imaging cylinder (PIC) 24 and an intermediate transfer member (ITM) 26 comprised in the printer, in accordance with an embodiment of the present invention. Digital printer 20 is schematically shown operating in a pressure calibration mode during which PAA 22 automatically adjusts pressure between PIC 24 and ITM 26. FIG. 1 shows only elements and features of digital printer 20 that are germane to the discussion. Features and elements other than those shown in FIG. 1 may be present in the printer, and as various layouts and constructional features for printers are known in the art and the present invention is applicable to many types of printers, the printer may be different from that shown.

PIC 24 has a photosurface 28 and is optionally supported on a shaft 30 having ends 31 and 32, which is mounted to a suitable support frame (not shown) of printer 20. ITM 26 has a transfer surface, optionally a surface 35 of a removable printing blanket 36, and is optionally supported on a shaft 38 mounted to the printer support frame.

Photosurface 28 and surface 35 of ITM 26 contact each other along a nip 40. An impression roller 42 is mounted to the printer support frame so that it presses against ITM 26 along a nip 44. A conveyor 46 feeds unprinted substrate sheets, optionally paper sheets 60, for printing to nip 44 in a "printing direction" indicated by a block arrow 48 and sheets printed by the printer are transported away from nip 44 by a conveyor 50. Arrows 52 indicate directions in which PIC, ITM and impression roller 34 rotate during printing.

In the printing process, as PIC rotates, a charger 53 charges photosurface 28 so that it has a substantially uniform surface charge density. A laser unit 54 comprising a laser (not shown) and associated optics (not shown) scans a laser beam 55 over photosurface 28 as it rotates to discharge regions of the photosurface and generate a latent image (not shown) of charged and uncharged pixels on the photosurface responsive to an image to be printed on paper sheets 60. A developer 56 applies toner of suitable color to, optionally, the charged pixels in the latent image as the latent image passes beneath the developer. The toner is transferred from the latent image to blanket 36 of ITM 26 at nip 40 between the PIC and the ITM. Toner is subsequently transferred from the blanket to a sheet of paper 60 fed to nip 44 between ITM 26 and impression roller 42 by conveyor 46 as the sheet passes through the nip to print the image on the paper.

As noted above, transfer of toner from PIC 24 to ITM 26 is sensitive to pressure between photosurface 28 and blanket 36 at nip 40. If the pressure is too high, the image transferred to blanket 36 may tend to be blurred. In addition wear rates of photosurface 28 and blanket 36 tend to be increased and temperatures of the photosurface and blanket tend to be elevated, causing undesirable increase in the temperature of the toner. If the pressure is too low, insufficient toner is transferred from the PIC to the ITM resulting in faded colors in an image printed by the printer. If pressure is not substantially the same all along nip 40, efficiency and quality of toner transfer between PIC 24 and ITM 26 will vary along the nip. As a result, a printed image may exhibit a tendency to being mottled because of too much or too little toner being transferred to different portions of the image and quality of the image may be degraded.

For adjusting pressure between PIC 24 and ITM 26 along their nip 40, PAA 22 optionally comprises a controller 70, at least one densitometer and an actuator or motor, hereinafter, generically, a motor 71, coupled to end 31 of shaft 30 and a motor 72 coupled to end 32 of the shaft.

By way of example, the at least one densitometer comprises a first densitometer 81 and a second densitometer 82 located near opposite sides of conveyor 50. Densitometers 81 and 82 are positioned along their respective opposite sides of the conveyor so that as a sheet of paper 60 is transported away from nip 44, regions of the sheet along edges 61 and 62 of the sheet pass through the fields of view of densitometers 81 and 82 respectively. Optionally, the regions of the sheets along edges 61 and 62 that pass through the fields of views of densitometers 81 and 82 are located substantially a same distance from the edges. FIG. 1 shows a sheet of paper 60 being transported away from nip 44, and a field of view of each densitometer 81 and 82 is schematically indicated on the sheet by a dashed circle 83 and 84 respectively.

Each motor 71 and 72 is optionally independently controlled by controller 70 and is coupled to shaft 30 near its respective shaft end 31 and 32, so that controller 70 can control the motor to move the shaft end to which it is coupled selectively towards or away from shaft 38 that supports ITM 26. Any of various methods and devices known in the art may be used to couple motors 71 and 72 to ends 31 and 32. Controller 70 can therefore selectively increase or decrease pressure between PIC 24 and ITM 26 along nip 40 by controlling motors 71 and 72 to move ends 31 and 32 of shaft 30 respectively towards or away from shaft 38.

Since motors 71 and 72 are, optionally, controlled independently of each other, controller 70 can control the motors to move their respective shaft ends 31 and 32 by different amounts and/or, selectively, in opposite directions towards or away from ITM shaft 38. As a result, not only can controller 70 increase or decrease pressure between PIC 24 and ITM 26 but can operate the motors so that pressure between the PIC and ITM in regions of nip 44 near ends 31 and 32 of shaft 30 is substantially the same. Controller 70 can thereby substantially equalize pressure between the PIC and the ITM at points along their nip 40.

Controller 70 determines by how much and in what direction (towards or away from shaft 38) to move each shaft end 31 and 32 responsive to signals it receives from densitometers 81 and 82. The densitometers generate the signals responsive to optical densities of test patterns, represented for convenience by circular shaded regions 91 and 92, which printer 20 prints on a plurality of sheets 60 when operating in the pressure calibration mode.

Printed test patterns 91 and 92 are printed copies, optionally of a same test pattern. Optionally, the printed test patterns are copies of a test pattern having a pattern of dots characterized by a dot-area coverage, DA, between about 65% and about 95%. Optionally, the printed test patterns are copies of a test pattern having a pattern of dots characterized by a DA of about 85%.

The printed test patterns are located near edges 61 and 62 of printed sheets 60 so that when each of the printed sheets is transported away from nip 44, at least a portion of the printed test patterns pass through fields of view 83 and 84. FIG. 1 schematically shows printed test patterns 91 and 92 on a sheet 60 located in fields of view 83 and 84 of densitometers 81 and 82. The shape of the test patterns shown in the figure is not a required limitation of the practice of the invention and substantially any shape test pattern may be used. However, it is noted that for enhanced reliability and accuracy of measurements provided by densitometers 81 and 82 it is generally advantageous for the printed test patterns to be larger than the fields of view 83 and 84 of densitometers.

For a given test pattern design, the optical density of a printed version of the test pattern is a function of pressure between PIC 24 and ITM 26 in a region of their nip 40 where toner to print the test pattern is transferred from the PIC photosurface 28 to the ITM blanket 36. The optical density of printed test patterns 91 and 92 are therefore measures of pressure between the PIC and the ITM in regions of nip 40 relatively close respectively to ends 31 and 32 of shaft 30. As is the pressure, the ODs of printed images 91 and 92 are functions of proximity of ends 31 and 32 of shaft 30 to ITM shaft 38.

In accordance with an embodiment of the invention, each of a plurality of sheets 60 is printed with test patterns 91 and 92 for different distances between ITM shaft 38 and ends 31 and 32 of PIC shaft 30. The different distances are in a range of distances that extends from a maximum distance at which, optionally, signals from densitometers 81 and 82 indicate that the ODs of test patterns 91 and 92 are substantially less than desired. The range extends to a minimum distance at which, optionally, the densitometer signals indicate that the ODs of the test patterns are substantially equal to a maximum, $OD_M$, for the measured pattern. For each of the different distances, controller 70 processes signals from densitometers 81 and 82 to generate measures and/or indicators of the ODs of printed test patterns 91 and 92. It is convenient to represent the distance between ITM shaft 38 and ends 31 and 32 of PIC shaft 30 by $D_{31}$ and $D_{32}$. As distance $D_{31}$ or $D_{32}$ decreases towards the minimum distance, OD of the corresponding test pattern 91 or 92 approaches $OD_M$.

Optionally, relative dot-area coverages, DAs, of printed test images 91 and 92 are used as indicators and measures of the ODs of the images. Conventionally, DA, of a pattern printed on a region of a substrate is conventionally defined as a function of optical density in accordance with a following formula:

$$DA=100\times[1-10^{-(OD-OD_P)}]/[1-10^{-(OD_M-OD_P)}], \quad (1)$$

in which $OD_P$ is the optical density of the substrate without any printing thereon and DA is defined as a relative DA given in percent of a maximum dot-area coverage for the pattern $[1-10^{-(OD_M-OD_P)}]$ that occurs for the maximum optical density $OD_M$.

Let $DA_{31}$ and $DA_{32}$ represent values of DA that correspond respectively to the ODs of printed test images 91 and 92 for distances $D_{31}$ and $D_{32}$. In accordance with an embodiment of the invention, controller 70 uses values of $D_{31}$ and $D_{32}$ and corresponding values $DA_{31}$ and $DA_{32}$ to determine desired normative operating distances, $D^*_{31}$ and $D^*_{32}$, for distances $D_{31}$ and $D_{32}$. The normative operating distances are distances for which pressure between PIC 24 and ITM 26 in regions of nip 40 near PIC shaft ends 31 and 32 equal a same desired normative operating pressure P*.

After determining the normative distances $D^*_{31}$ and $D^*_{32}$, optionally, controller 70 controls motors 71 and 72 to set distances $D_{31}$ and $D_{32}$ to $D^*_{31}$ and $D^*_{32}$ respectively. Once the distances $D_{31}$ and $D_{32}$ are set equal to $D^*_{31}$ and $D^*_{32}$ pressure calibration of printer 20 is complete and controller 70 releases the printer for conventional printing of images in a normal printing mode. It is understood that the actual values of D may not be determined, but only differences from a reference distance.

In accordance with an embodiment of the invention, a normative operating pressure P* is a pressure for which dot-area coverages $DA_{31}$ and $DA_{32}$ have a same normative dot-area coverage DA*.

In some embodiments of the invention DA* has a value in a range from 0.96 to 0.98, a range from 0.94 to 0.96 or a range from 0.90 to 0.94. In some embodiments of the invention, DA* is equal to about 97%. In some embodiments of the invention, DA* is equal to about 95%.

The inventors have found that curves, "DA-curves" representing respectively $DA_{31}$ as a function of distance $D_{31}$ and $DA_{32}$ as a function of distance $D_{32}$ exhibit "knees" in a transition regions of the distances. For distances less than transition region distances, $DA_{31}$ and $DA_{32}$ increase relatively rapidly with decrease in $D_{31}$ and $D_{32}$ respectively and as a result, the DA-curves rise relatively rapidly with decreasing distances $D_{31}$ and $D_{32}$. For distances greater than distances in the transition region, $DA_{31}$ and $DA_{32}$ increase slowly with decrease in $D_{31}$ and $D_{32}$ respectively and the DA-curves rise slowly to the maximum DA of 100%.

In some embodiments of the invention, the normative dot-area coverage DA* has a value that is close to those represented by the knees in the DA-curves for printed test patterns 91 and 92. (It is noted that whereas $DA_{31}$ and $DA_{32}$ have been tacitly assumed to be dependent substantially only on $D_{31}$ and $D_{32}$ respectively, $DA_{31}$ and $DA_{32}$ may also exhibit, albeit generally weak, dependence on $D_{32}$ and $D_{31}$ respectively.)

In some embodiments of the invention, controller 70 generates calibration functions for $DA_{31}$ and $DA_{32}$ as dependent on distances $D_{31}$ and $D_{32}$. The controller uses the calibration functions to determine DA* and corresponding values for normative distances $D^*_{31}$ and $D^*_{32}$. Optionally, the controller uses the calibration functions to control motors 71 and 72 to set $D_{31}$ and $D_{32}$ equal to $D^*_{31}$ and $D^*_{32}$.

In some embodiments of the invention, controller 70 determines values for $D_{31}$ and $D_{32}$ for which $DA_{31}$ and $DA_{32}$ are substantially equal to about 100% and sets $D_{31}$ and $D_{32}$ to their respective determined 100% values. Then, as the printer prints test patterns 91 and 92, controller 70 controls motors 71 and 72 to increase distances $D_{31}$ and $D_{32}$ between the printings and monitors values of $DA_{31}$ and $DA_{32}$ as the distances increase. When a value of $DA_{31}$ or $DA_{32}$ becomes equal to the normative operating dot-area coverage, DA*, the controller controls the corresponding motor 71 or 72 to stop increasing its associated distance $D_{31}$ or $D_{32}$. When controller 70 has controlled both motors 71 and 72 to stop increasing their associated distances $D_{31}$ or $D_{32}$ the distances are set to $D^*_{31}$ or $D^*_{32}$.

Figure 2:
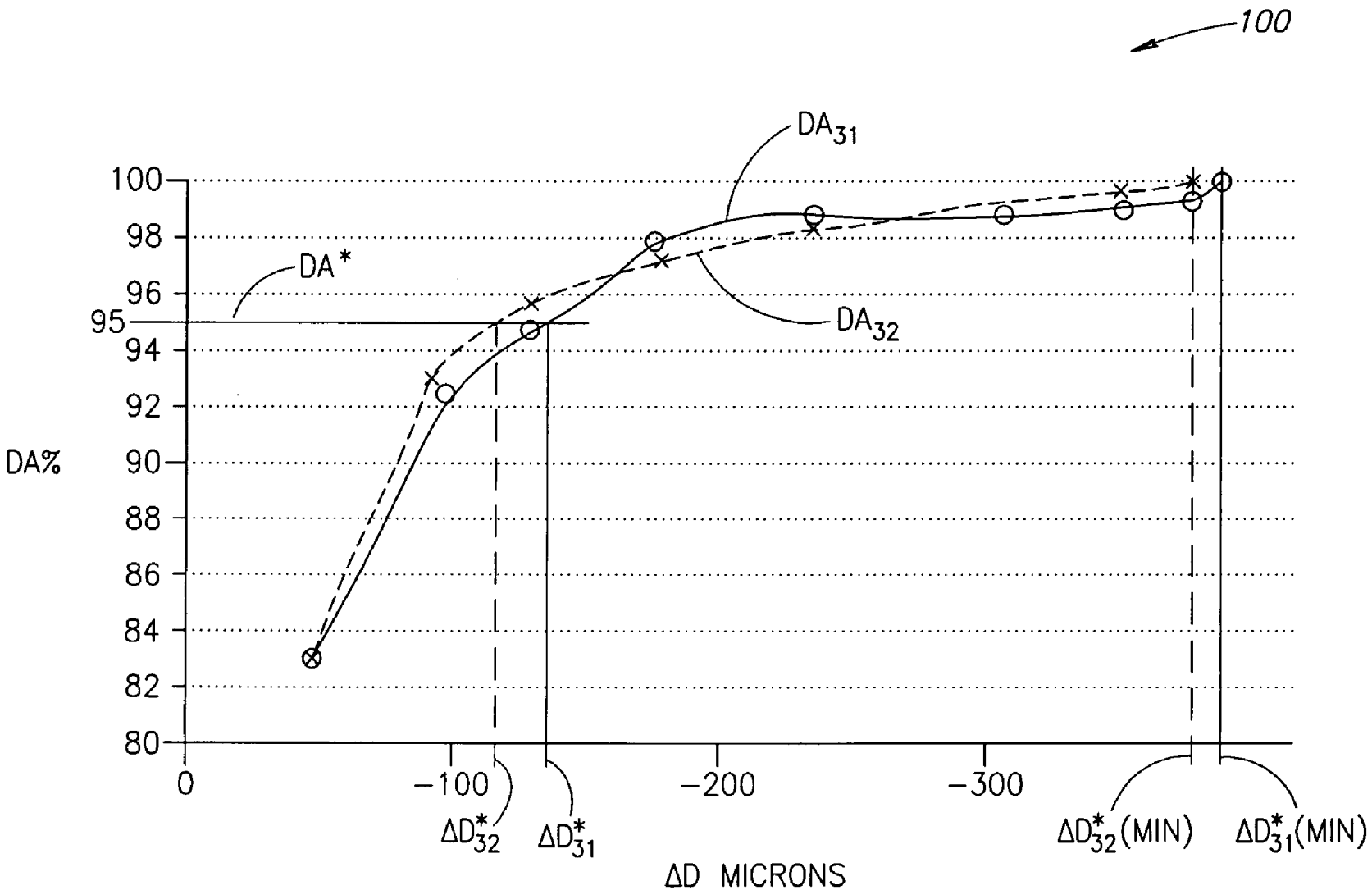
FIG. 2 shows a schematic graph of the optical density of a test pattern printed by the printer shown in FIG. 1 as a function of a measure of distance between axes of rotation of the PIC and ITM, in accordance with an embodiment of the invention.

FIG. 2 shows a schematic graph 100 of relative dot-area coverage DA for printed test patterns 91 and 92 as a function of distances $D_{31}$ and $D_{32}$ respectively. In the graph, distances $D_{31}$ and $D_{32}$ are measured relative to a distance "$D_{max}$" for which dot-area coverages $DA_{31}$ or $DA_{32}$ are substantially equal to zero. $D_{max}$ is used as a reference only and its exact value is not significant. The abscissa of graph 100 shows distance differences, $\Delta D$ from $D_{max}$, in microns. A curve labeled $DA_{31}$ shows $DA_{31}$ as a function of $\Delta D_{31}$ and a curve labeled $DA_{32}$ shows $DA_{32}$ as a function of $\Delta D_{32}$.

In graph 100, values for $\Delta D_{31}$ and $\Delta D_{32}$ for which $DA_{31}$ and $DA_{32}$ for printed test patterns 91 and 92 respectively are substantially equal to 100% (i.e., the maximum for the pattern printed) are indicated as $\Delta D_{31}$(MIN) and $\Delta D_{32}$ (MIN). A normative DA, DA*, is assumed, by way of example, to be equal to about 95% and a line that intersects curves $DA_{31}$ and $DA_{32}$ for DA=95% is labeled DA* in graph 100. Abscissa values in graph 100 corresponding to normative operating distances $D^*_{31}$ and $D^*_{32}$, for which ordinates of curves $D^*_{31}$ and $D^*_{32}$ are respectively equal to DA* are shown in the graph and labeled $\Delta D^*_{3}$1 and $\Delta D^*_{32}$.

It is noted that in graph 100 normative operating distances $D^*_{31}$ and $D^*_{32}$ (expressed in units of $\Delta D_{31}$ and $\Delta D_{32}$) are shown as having different values. Whereas, often $D^*_{31}$ and $D^*_{32}$ have substantially a same value, a situation can arise for which they may have different values, as a result for example, of uneven wear in blanket 36.

In the above exemplary embodiment of the invention pressure is monitored and controlled "indirectly" as functions of distances $D_{31}$ and $D_{32}$. In some embodiments of the invention pressure between PIC 24 and ITM 26 is monitored and controlled "directly" as functions of a pressure or force measurement. For example, in some embodiments of the invention, at least one suitable pressure gauge is mounted to ends 31 and 32 of PIC shaft 30 that transmits signals to controller 70 responsive to pressure that motors 71 and 72 apply to their respective ends of the shaft. The controller correlates the signals with OD measurements (optionally, expressed as DA measurements) and controls the motors to maintain a desired normative operating pressure P* by controlling the motors to maintain corresponding values of pressure as measured by the at least one pressure gauge. Furthermore, whereas in the above exemplary embodiment, densitometers are positioned on opposite sides of conveyor 50, in some embodiments of the invention, the densitometers are positioned on opposite sides of an output tray (not shown) of printer 20.

A printer 20 comprising a PAA in accordance with an embodiment of the invention optionally operates in a monitoring mode after operating in a calibration mode. In a monitoring mode, in some embodiments of the invention, printer 20 operates conventionally to print an image on sheets 60. In addition, the printer prints at least one test pattern, hereinafter a "monitor test pattern", on a region or regions of sheets 60, such as for example a margin along one or both edges 61 and 62 of the sheets that is intended to be trimmed away after printing. Densitometer 81 and/or 82 transmits signals responsive to the at least one monitor test pattern to controller 70. Controller 70 processes the signals to determine if they indicate that pressure between PIC 24 and ITM 26 has varied from the normative operating pressure P*.

In some embodiments of the invention, if pressure variance is less than a predetermined variance upper limit, controller 70 controls motors 71 and 72 to adjust distances $D_{31}$ and $D_{32}$ to restore pressure between PIC 24 and ITM 26 to P*. Distance adjustments are optionally made responsive to calibration functions for $DA_{31}$ and $DA_{32}$ as dependent on $D_{31}$ and $D_{32}$ determined during operation of the printer in a calibration mode. If the variance is greater than the upper limit, controller 70 optionally generates a signal indicating that operator intervention is required and/or stops normal printing operation and reverts to a calibration mode to reset distances $D_{31}$ and $D_{32}$.

In the description and claims of the present application, each of the verbs, "comprise" "include" and "have", and conjugates thereof, are used to indicate that the object or objects of the verb are not necessarily a complete listing of members, components, elements or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art. The scope of the invention is limited only by the following claims.

The invention claimed is:

1. Apparatus for equalizing pressure along a nip between a photosensitive imaging cylinder (PIC) and an intermediate transfer member (ITM) in a printing press comprising:

first and second optical sensors having first and second fields of view respectively that view different first and second regions of a substrate printed by the printer and generate signals responsive to the optical densities of first and second test patterns printed by the printer on the first and second regions of the substrate;

at least one motor operable to control pressure between the rollers; and a controller that receives the signals and controls the at least one motor responsive to the signals to equalize the pressure along the nip, wherein the controller controls the at least one motor to adjust the pressure so that on a substrate printed by the printer the signals indicate that the optical densities of the first and second patterns have substantially a same optical density.

2. Apparatus according to claim 1 wherein the first and second optical sensors are densitometers.

3. Apparatus according to claim 1, wherein the optical densities of the first arid second patterns are relative optical densities, relative to maximum optical densities respectively of the first and second patterns.

4. Apparatus according to claim 3 wherein the same relative optical density indicated by the signals has a value in a range from 0.96 to 0.98.

5. Apparatus according to claim 3 wherein the same relative optical density indicated by the signals has a value in a range from 0.94 to 0.96.

6. Apparatus according to claim 3 wherein the same relative optical density indicated by the signals has a value in a range from 0.90 to 0.94.

7. Apparatus according to claim 1 wherein the first and second printed test patterns are printed copies of a same test pattern.

8. Apparatus according to claim 1 wherein the first and second regions are located adjacent first and second opposite edges of the substrate that are substantially parallel to a printing direction of the printer.

9. Apparatus according to claim 8 wherein the first and second regions are homologously located with respect to the first and second edges respectively.

10. An apparatus for equalizing pressure along a nip between a photosensitive imaging cylinder (PIC) and an intermediate transfer member (ITM) in a printing press comprising:

first and second optical sensors having first and second fields of view respectively that view different first and second regions of a substrate printed by the printer and generate signals responsive to the optical densities of first and second test patterns printed by the printer on the first and second regions of the substrate;

at least one motor operable to control pressure between the rollers; and a controller that receives the signals and controls the at least one motor responsive to the signals to equalize the pressure along the nip, wherein the controller controls the printer to print the first and second test patterns on a plurality of substrate sheets, and wherein the controller controls the at least one motor so that different substrates of the plurality of substrates are printed with the test patterns at different values for the first and second distances;

wherein an axis of rotation of the PIC has first and second ends near opposite first and second ends of the nip, which first and second ends of the PIC axis are located at first and second distances respectively from an axis of rotation of the ITM, and the at least one motor is controllable by the controller to selectively move the first and second axis ends towards or away from the ITM axis to respectively increase or decrease pressure between the PIC and the ITM in regions of the first and second ends of the nip.

11. Apparatus according to claim 10 wherein the controller controls the at least one motor to move the first and second ends independently of each other.

12. Apparatus according to claim 10 wherein the different distance values are in a range of distance values comprising first and second minimum values for which signals generated by the first and second optical sensors respectively indicate that the optical densities of the first and second test patterns are substantially equal to a maximum optical density, $OD_M$, for the test patterns.

13. Apparatus according to claim 10 wherein the different values for the distances are in a range of distances comprising first and second maximum distances for which signals generated by the first and second optical sensors respectively indicate that the optical densities of the first and second test patters are equal to an optical density substantially less than $OD_M$.

14. Apparatus according to claim 10 wherein for each of the different values of the first and second distances, the controller 5 determines a value for dot-area coverages (DA) of the first and second test patterns responsive to signals from the first and second optical sensors.

15. Apparatus according to claim 14 wherein the controller determines first and second normative operating distances respectively for the first and second distances responsive to the different distance values at which the first and second test patterns are printed and their associated values of DA and for which normative operating distances, the DAs of the first and second test patterns are substantially equal to a same desired normative dot-area coverage DA*.

16. Apparatus according to claim 15 wherein the controller determines DA* responsive to a maximum value for DA that occurs when the optical densities of the first and second patterns are maximum.

17. Apparatus according to claim 16 wherein DA* has a value that is in a range from 0.96 to 0.98 of the maximum DA.

18. Apparatus according to claim 17 wherein DA* has a value that is in a range from 0.94 to 0.96 of the maximum DA.

19. Apparatus according to claim 17 wherein DA* has a value that is in a range from 0.90 to 0.94 of the maximum DA.

20. Apparatus according to claim 15 wherein the controller determines a functional relationship for the DA of each of the first and second test patterns tat relates the DA of the test pattern to the first and second distance respectively and uses the functional relationships to determine DA*.

21. Apparatus according to claim 20 wherein each functional relationship is characterized by a transition region of distances in which a rate of change of DA changes from a relatively rapid to a relatively slow increase with decrease in the first or second distance and the controller determines DA* responsive to values of DA for distances in the transition region.

22. Apparatus according to claim 21 wherein the controller determines DA* equal to a value of DA for which the first and second distances are distances in or near the transition region.

23. Apparatus according to claim 15 wherein the controller controls the at least one motor to set the first distance substantially equal to the first normative operating distance and the second distance substantially equal to the second normative operating distance.

24. Apparatus according to claim 23 wherein during printing of non-test images on additional substrates, after the controller has set the first and second distances to the first and second normative operating distances, the printer prints at least one monitor test pattern on a region of the substrates that is not printed with the images and at least one of the first and second optical sensors generates signals responsive to the optical density of the at least one monitor test pattern.

25. Apparatus according to claim 24 wherein if the monitor test signal indicate that, were first and second test patterns to be printed again, the optical density would to differ from DA* by an amount greater than or equal to a predetermined difference, the controller controls the at least one motor to adjust the first and/or second distance.

26. Apparatus according to claim 24 wherein if the monitor test signal indicate that, were first and second test patterns to be printed again, the optical density would to differ from DA* by an amount greater than or equal to a predetermined threshold difference, the controller generates a signal indicating that operator intervention is required.

27. A method for equalizing pressure along a nip between a photosensitive imaging cylinder (PIC) and an intermediate transfer member (ITM) in a printing press, comprising:

controlling the printer to print first and second test patterns on different regions of at least one substrate;

sensing the optical densities, ODs, of the printed test patterns;

automatically substantially equalizing the pressure along the nip responsive to the sensed optical densities;

sensing for each of the different values of the first and second distances, the ODs of the first and second test patterns; and determining for each of the different values of the first and second distances, a value for dot-area coverages (DA) of the first and second test patterns responsive to the ODs of the sensed ODs of the patterns;

wherein the PIC has an axis of rotation havin first and second ends near opposite first and second ends of the nip, which first and second ends of the PIC axis are located at first and second distances respectively from an axis of rotation of the ITM, and controlling the printer to print the first and second test patterns comprises controlling the printer to print the test patterns at different values for the first and second distances.

28. A method according to claim 27 and determining first and second normative operating distances respectively for the first and second distances responsive to the different distance values at which the first and second test patterns are printed and their associated DA values and for which normative operating distances the DAs of the first and second test patterns are substantially equal to a same normative optical density DA* and pressure along the nip is substantially equalized.

29. A method according to claim 28 and determining DA* responsive to a maximum value for DA that occurs when the optical densities of the first and second patterns are maximum.

30. A method according to claim 29 and determining DA* to have a value in a range from 0.96 to 0.98.

31. A method according to claim 29 and determining DA* to have a value in a range from 0.94 to 0.96.

32. A method according to claim 29 and determining DA* to have a value in a range from 0.90 to 0.94.

33. A method according to claim 29 and comprising determining a functional relationship for the DA of each of the first and second test patterns that relates the DA of the test pattern to the first and second distance respectively and using the functional relationships to determine DA*.

34. A method according to claim 33 wherein each functional relationship is characterized by a transition region of distances in which a rate of change of DA changes from a relatively rapid to a relatively slow increase with decrease in the first or second distance and comprising determining DA* responsive to values of DA for distances in the transition region.

35. A method according to claim 28 wherein the different values for the distances are in a range of distances comprising first and second maximum distances for which the optical densities of the first and second test patters are substantially equal to an OD substantially less than $OD_M$.

36. A method according to claim 28 wherein the different distance values are in a range of distance values comprising first and second minimum values for which the optical densities of the first and second test patterns are substantially equal to a maximum optical density, $OD_M$, for the test patterns.

37. A method according to claim 28 wherein substantially equalizing the pressure along the nip comprises setting the first distance substantially equal to the first normative operating distance and the second distance substantially equal to the second normative operating distance.

38. A method according to claim 36 and comprising:

during conventional printing of images on substrates after equalizing the pressure, controlling the printer to print at least one monitor test pattern on a region of the substrates that is not printed with the images;

automatically sensing the optical density of the at least one test pattern; and determining if optical density in regions along the nip is the same to within a predetermined maximum difference responsive to the sensed optical density.

39. A method according to claim 36 and comprising:

during conventional printing of images on substrates after equalizing the pressure, controlling the printer to print at least one monitor test pattern on a region of the substrates that is not printed with the images;

automatically sensing the optical density of the at least one test pattern; and determining if pressure in regions along the nip is the same to within a predetermined maximum difference responsive to the sensed optical density.

40. Apparatus for adjusting pressure between a first and a second roller in a printing press that contact each other, comprising:

at least one optical sensor that generates signals responsive to the optical density of at least one test pattern that the printer prints on substrates, wherein the at least one optical sensor comprises first and second optical sensors having first and second fields of view respectively that view different first and second regions of a substrate printed by the printer;

at least one motor operable to control pressure between the rollers; and a controller that receives the optical sensor signals and controls the at least one motor responsive to the signals, wherein the controller controls the at least one motor to adjust the pressure so that that the signals indicate that the optical densities of the first and second patterns have substantially a same optical density.

41. Apparatus according to claim 40 wherein the optical densities of the first and second patterns are relative optical densities, relative to maximum optical densities respectively of the first and second patterns.

42. Apparatus according to claim 41 wherein the same relative optical density indicated by the signals has a value in a range from 0.96 to 0.98.

43. Apparatus according to claim 41 wherein the same relative optical density indicated by the signals has a value in a range from 0.94 to 0.96.

44. Apparatus according to claim 41 wherein the same relative optical density indicated by the signals has a value in a range from 0.90 to 0.94.

45. Apparatus according to claim 40 wherein the first roller is a photosensitive imaging cylinder (PIC) in the printing press.

46. Apparatus according to claim 40 wherein the second roller is an intermediate transfer member (ITM) in the printing press.

47. Apparatus according to claim 40 wherein the at least one optical sensor comprises at least one densitometer.

* * * * *

UNITED STATES PATENT AND TRADEMARK OFFICE

CERTIFICATE OF CORRECTION

PATENT NO. : 7,151,248 B2
APPLICATION NO. : 10/890614
DATED : December 19, 2006
INVENTOR(S) : Shlomo Harush et al.

It is certified that error appears in the above-identified patent and that said Letters Patent is hereby corrected as shown below:

On the Title page, in field (75), in "Inventors", in column 1, line 2, delete "Rehovot (IL)" and insert -- Cupertino, CA (US) --, therefor.

In column 13, line 15, in Claim 3, after "claim 1" delete ",".

In column 13, line 16, in Claim 3, delete "arid" and insert -- and --, therefor.

In column 14, line 19, in Claim 13, delete "patters" and insert -- patterns --, therefor.

In column 14, line 49, in Claim 20, delete "tat" and insert -- that --, therefor.

In column 15, line 37, in Claim 27, delete "havin" and insert -- having --, therefor.

In column 16, line 13, in Claim 35, delete "patters" and insert -- patterns --, therefor.

In column 16, line 61, in Claim 40, after "so that" delete "that".

Signed and Sealed this

Twenty-fifth Day of November, 2008

JON W. DUDAS
*Director of the United States Patent and Trademark Office*